US005452739A

United States Patent [19]

Mustee et al.

[11] Patent Number: 5,452,739

[45] Date of Patent: Sep. 26, 1995

[54] OVERFLOW TRAY

[75] Inventors: Robert J. Mustee; William E. Trsek, both of Middleburg Heights, Ohio

[73] Assignee: E. L. Mustee & Sons, Inc., Cleveland, Ohio

[21] Appl. No.: 290,564

[22] Filed: Aug. 15, 1994

[51] Int. Cl.[6] ..... D06F 35/00; B65D 6/04

[52] U.S. Cl. ..... 137/312; 4/251.1; 137/315; 137/357; 220/571; 222/108

[58] Field of Search ..... 4/251.1, 613, 614; 137/312, 315, 360, 362, 357; 222/108; 220/571, 572, DIG. 6; 248/346, 346.1

[56] References Cited

U.S. PATENT DOCUMENTS

| | | | |
|---|---|---|---|
| D. 347,468 | 5/1994 | Johnson | D23/270 |
| 3,304,950 | 2/1967 | Hubert | 137/312 |
| 3,606,617 | 9/1971 | Frazier | 4/613 |
| 3,800,335 | 4/1974 | Buonaura | 4/613 |
| 3,895,398 | 7/1975 | Mustee | 4/613 |
| 4,765,360 | 8/1988 | Baird | 137/312 |
| 4,889,155 | 12/1989 | Trotter, Sr. | 137/312 |
| 4,903,723 | 2/1990 | Sublett | 137/312 |
| 4,993,087 | 2/1991 | Roquebrune | 4/604 |
| 5,099,873 | 3/1992 | Sanchez | 137/312 |
| 5,199,457 | 4/1993 | Miller | 137/312 |
| 5,224,508 | 7/1993 | Bates, Jr. | 137/312 |

*Primary Examiner*—George L. Walton
*Attorney, Agent, or Firm*—Watts, Hoffmann, Fisher & Heinke Co.

[57] ABSTRACT

An overflow tray for use with a water containing appliance. The overflow tray comprises a base for receiving and supporting a water containing appliance. A plurality of walls extend transversely from the base to define a watertight container. One of the walls has a pair of end portions cooperating with the base to define a frame. Each end portion connects a respective one of a pair of the walls to the base. Each end portion has a length greater than the thickness of a connected wall to reinforce and strengthen the connected wall adjacent the one wall. The one wall further includes a removable gate receivable in the frame and extendable between the end portions. A groove is located in one of the removable gate and the frame. A projection is located on the other of the removable gate and the frame for receipt in the groove and engagement with an elastomeric seal to form a watertight seal in the one wall.

10 Claims, 3 Drawing Sheets

OVERFLOW TRAY

BACKGROUND OF THE INVENTION

1. Technical Field

The present invention relates generally to an overflow tray for use with water containing appliances, and particularly to an overflow tray for use with a clothes washing machine.

2. Description of the Prior Art

Overflow trays for use with water containing appliances, such as water coolers, dishwashers and washing machines, are known. The purpose of these trays is to guard against water damage resulting from overflow, leaks, tank or seal failures, etc. occurring in the appliance. Overflow trays are particularly recommended in apartments and modern homes where wash areas are located above a lower floor.

One prior art proposal for a washing machine overflow tray is disclosed in U.S. Pat. No. 3,304,950. The tray includes a removable vertical gate extending between side walls to function as a front wall. A tongue and groove structure seals and holds the vertical gate to the bottom wall and to the side walls. A spigot valve is located in the vertical gate for the disclosed purpose of draining water from the tray.

The tray of U.S. Pat. No. 3,304,950 suffers from several disadvantages. A principle disadvantage is that it does not have a drain outlet to automatically conduct water away from the tray. The spigot valve requires that a person to be present and attentive in order to open the spigot. Even if the spigot is properly opened to drain the tray, some amount of water will remain below the spigot. Parts of the washing machine will stand in the water and rust or the water could stagnate to the point of creating a discernable odor. Another disadvantage is that in order to drain water from the tray, a hose must be connected to the spigot to direct the water away from the tray or a relatively flat container must be placed under the spigot and continually filled and emptied. Another disadvantage is that the prior art tray cannot accommodate water in volumes larger than the volume of the tray as could occur during a catastrophic failure in the appliance.

Another disadvantage of the known tray is that the side walls are perpendicular to the bottom wall and near the vertical gate the side walls have very little support or strength to prevent the side walls from moving relative to one another. For example, as the washing machine is placed on the floor of the tray, it is slid into place. During this sliding movement of the washing machine, a side wall can be contacted by the washing machine and broken, damaged or cracked all of which can lead to water leaking from the tray. This damaging contact can also occur from an imbalanced condition of the washing machine during operation. The washing machine can contact the side walls near the vertical gate and displace the side walls even a slight amount without causing permanent damage to the tray. This contact could result in disrupting the seal between the vertical gate and the bottom wall or side walls to permit water leaking from the tray.

Another known prior art attempt at protecting a support surface from leaks, spills, overflows and failures of a water-containing appliance includes providing a relatively thin-walled vacuum formed plastic drip pan. This prior art drip pan is prone to breakage when the appliance vibrates during use. The prior art drip pan has no provision for connecting to a drain system other than a garden hose attached to a side of the drip pan. The prior art drip pan cannot contain the fourteen to twenty-two gallons of water that is typically present in a washing machine. The prior art drip pan also has no removable gate or wall for ease of placing a washing machine on the drip pan without lifting.

SUMMARY OF THE INVENTION

The present invention provides a new overflow tray for a washing machine or other water-containing appliances and which overcomes the disadvantages of prior art trays. In particular, the new tray is constructed so it can receive and continuously drain away the relatively large volumes of water that may occur when the appliance fails or overflows. Another advantageous feature is a gate or wall that can be removed to permit the appliance to be placed on the tray and then replaced to form a watertight seal which will not be broken if the appliance is inadvertently moved or vibrates in use. All of these features and advantages are achieved by a construction that is strong, durable and inexpensively manufactured.

The overflow tray embodying the present invention comprises a base for supporting a water-containing appliance. Four upstanding walls extend from the base to define a receptacle for receiving water discharged from the appliance. The base has an outlet opening adapted to be connected to a drain and surface portions sloping from the walls to the opening so water drains in a direction away from the walls towards the opening. The outlet opening is located substantially at the center of the base. At least one wall includes a removable gate that can be assembled in watertight engagement with the other walls and the base and selectively removed to permit the appliance to be slid onto and off of the base.

The one wall has a pair of end portions cooperating with the base to define a frame. Each end portion connects a respective wall adjacent the one wall to the base and has a length which is greater than the thickness of a connected adjacent wall to strengthen the connected adjacent wall. Each end portion has a first part adjacent the base having a length which is greater than the length of a second part of the end portion spaced from the base. The removable gate is receivable in the frame and extendable between the end portions.

A groove is provided in one of the removable gate and the frame. A projection is provided on the other of the removable gate and the frame and is receivable in the groove to form a watertight seal in the one wall. In one embodiment the groove is located in the frame and extends substantially for the entire periphery of the frame. The projection is located on the removable gate and continuously extends from the periphery of the removable gate that engages the frame.

The overflow tray further includes four openings in the base for receiving a respective fastener in a watertight relationship to fix the overflow tray to a support surface, such as a wooden floor. The overflow tray also includes a pair of fasteners for retaining a respective end of the removable gate in engagement with an end portion to inhibit the connected walls adjacent from moving relative to one another and relative to the base. The overflow tray has at least one substantially planar portion of the base for directly supporting legs of the appliance. A radiused surface extends between the base and each of the connected adjacent walls.

BRIEF DESCRIPTION OF THE DRAWINGS

Further features of the present invention will become apparent to those skilled in the art to which the present invention relates from reading the following specification with reference to the accompanying drawings, in which:

FIG. 5 is a view similar to FIG. 3 with parts in different positions;

FIG. 6 is an enlarged exploded perspective view of a portion of the overflow tray of FIG. 2;

FIG. 7 is an enlarged cross-sectional view of a mounting portion of the overflow tray, taken approximately along line 7—7 of FIG. 2; and FIG. 8 is an enlarged cross-sectional view of a frame portion of the overflow tray, taken approximately along line 8—8 of FIG. 5.

DESCRIPTION OF THE PREFERRED EMBODIMENT

Figure 1:
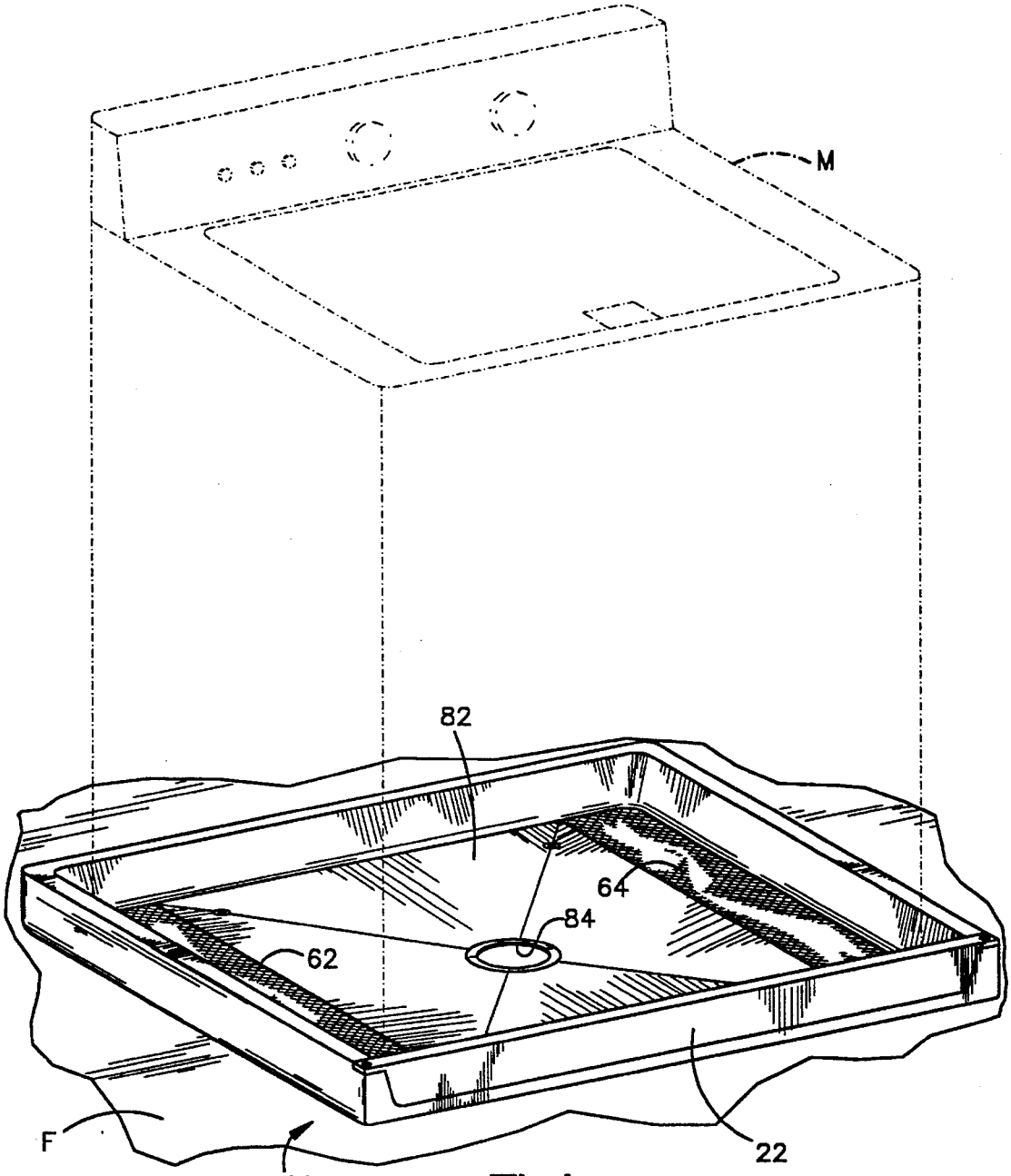
FIG. 1 is a perspective view of the overflow tray, embodying the present invention, located on a floor and supporting a washing machine.

An overflow tray 20, embodying the present invention, is illustrated in FIG. 1 for use with a water-containing appliance M, such as a washing machine. The overflow tray 20 is supported on a floor F, such as a wood floor, although it will be apparent that the overflow tray can be embedded in the floor, such as a concrete floor, if desired. The overflow tray 20 functions to catch and contain any water or liquid that spills, leaks or overflows from the water-containing appliance M. The overflow tray 20 is intended to have a drainage system operatively connected to it in order to direct away water which occurs in a volume greater than the volume that the overflow tray can contain. The overflow tray 20 has a removable front gate 22 that permits the water containing appliance M to be slid into position on the overflow tray when removed and provides a watertight seal when it is in place.

Figure 2:
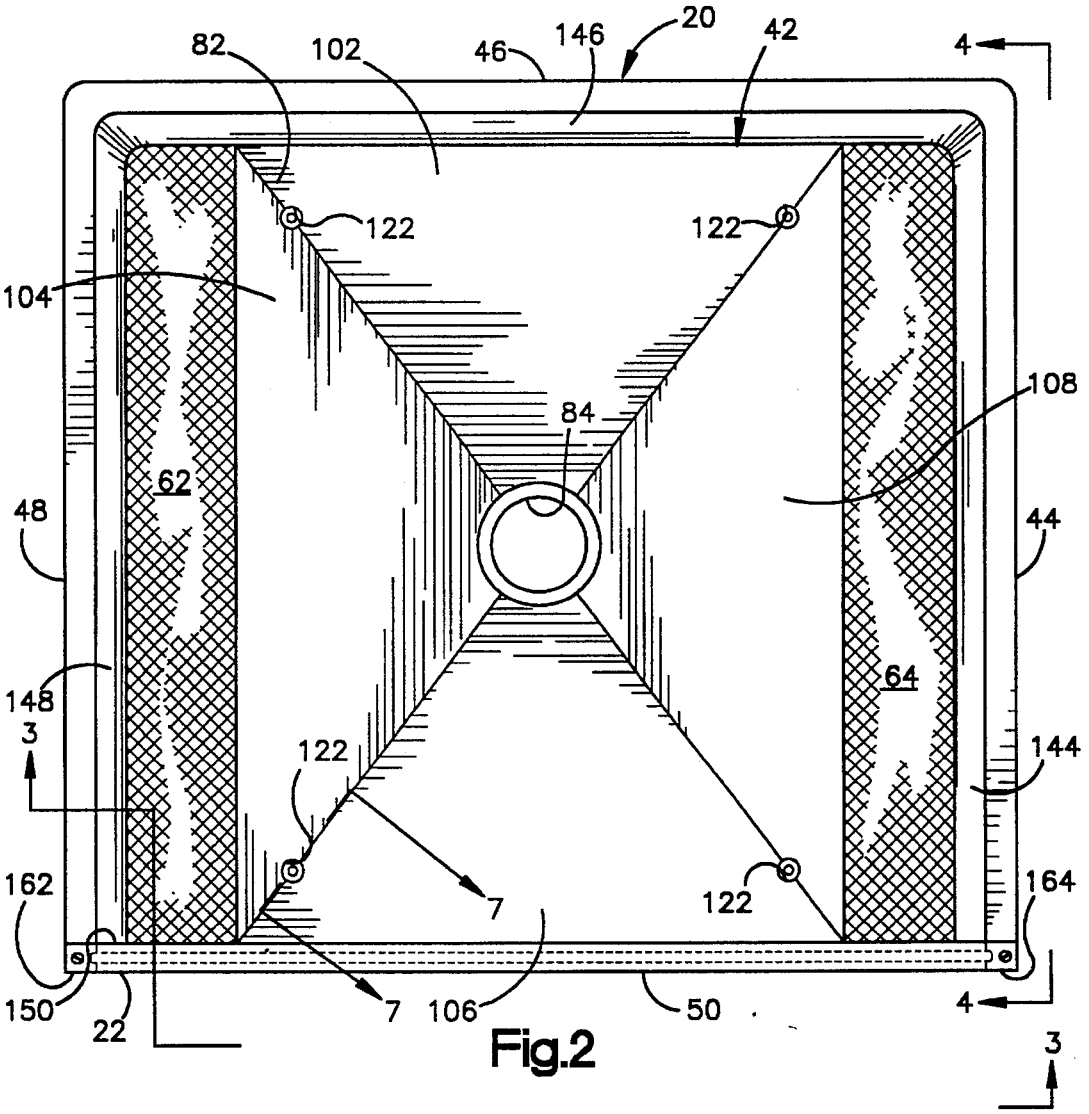
FIG. 2 is a top plan view of the overflow tray of FIG. 1.

The overflow tray 20 includes a base 42 for receiving and supporting the water-containing appliance M and for directing water to a predetermined location. The base 42 has four edges 44, 46, 48, 50 which define a rectangular shape, as viewed in FIG. 2. The base 42 has a pair of spaced apart and substantially co-planar support surfaces 62, 64 for receiving and supporting legs of the appliance M. The support surfaces 62, 64 are intended to be located substantially level relative to the floor F. The support surfaces 62, 64 include a non-skid surface for preventing movement of the appliance M relative to the base 42. The non-skid surface may be a roughened surface that is integrally formed into the base 42. The non-skid surface may also be a sheet with a roughened surface applied to the base 42 in a manufacturing operation after the base is formed.

The base 42 also includes a central 82 portion that has an opening 84 centrally located for receiving a standard two-inch drain fixture (not shown) which is connected to drainage plumbing. The central portion 82 has four generally flat surfaces 102, 104, 106, 108, each of which slopes at a relatively small angle towards the opening 84 so any water on the central portion is directed toward the opening.

There are also four smaller openings 122 located in the central area 82 of the base 42. Each opening 122 (FIG. 7) receives a fastener 124 and an elastomeric washer 126. The fastener 124 extends through the washer 126 and opening 122 in a watertight relationship to fix the overflow tray 20 to the floor F. This prevents movement of the overflow tray 20 relative to the floor F which may occur during installation and operation of the appliance M.

Figure 3:
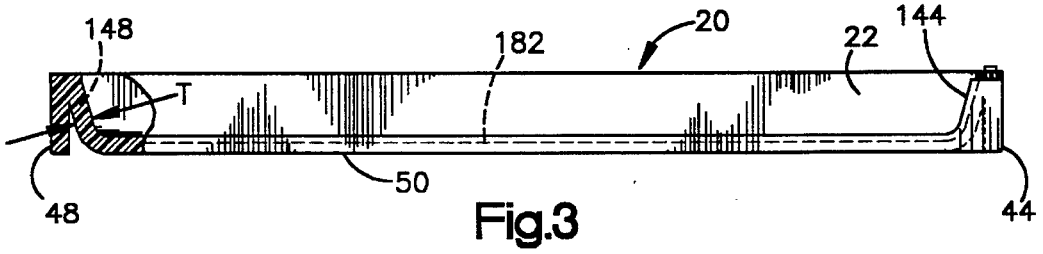
FIG. 3 is a front elevational view of the overflow tray of FIG. 2, taken along the line 3—3 in FIG. 2.
Figure 4:
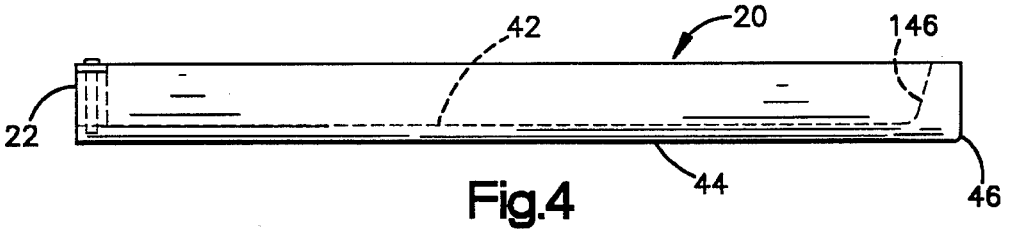
FIG. 4 is a side elevational view of the overflow tray of FIG. 2, taken along the line 4—4 in FIG. 2.
Figure 1:
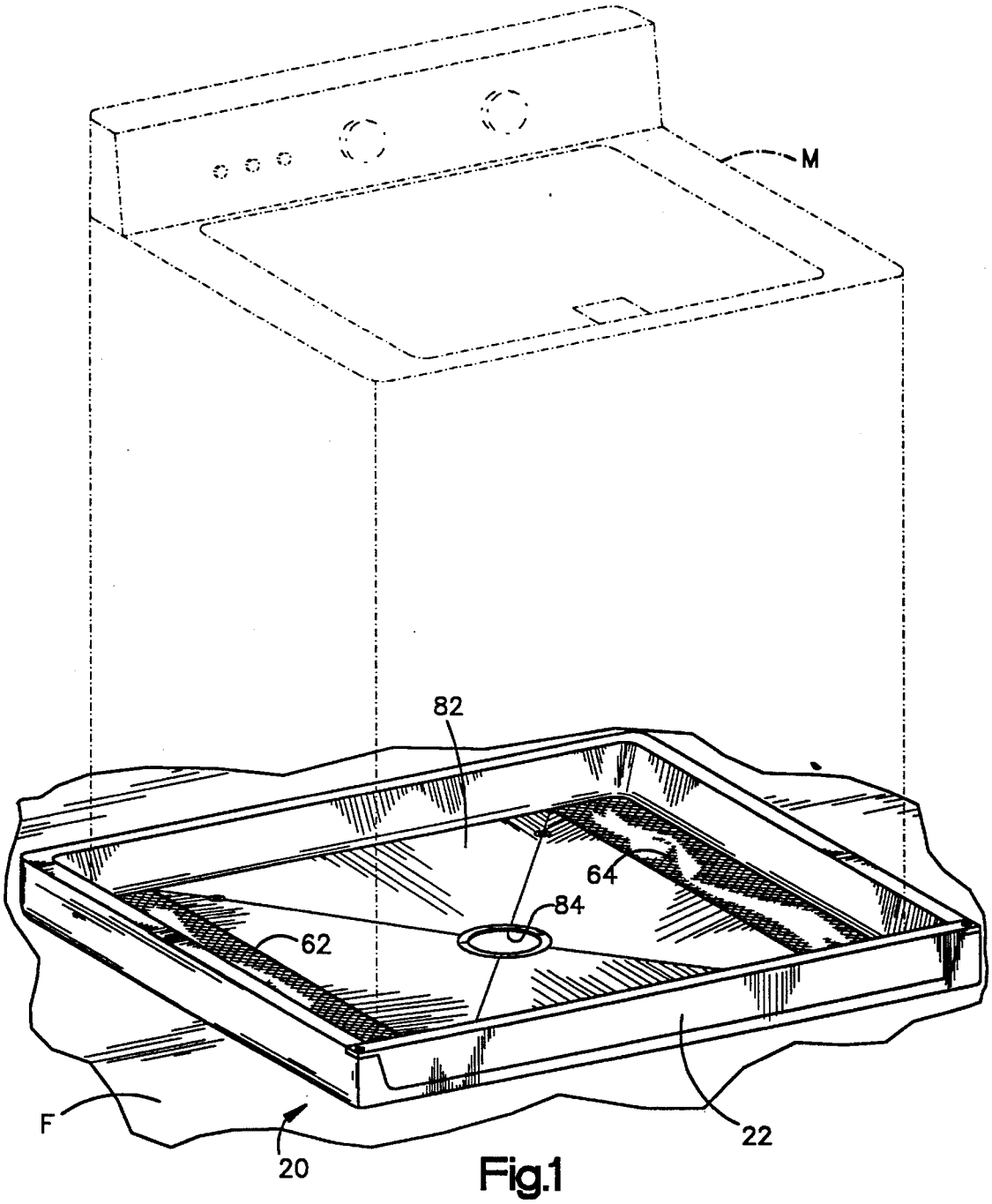

Each of a plurality of walls 144, 146, 148, 150 (FIGS. 2, 3 and 4) extend transversely and upwardly from the base 42 adjacent each edge 44, 46, 48, 50 of the base. The walls 144, 146, 148, 150 are connected together and cooperate with the base 42 to define a watertight container that stores a volume of water that may leak, spill or overflow from the appliance M. Three of the walls 144, 146, 148, the base 42 and portions of the front wall 150 are integrally molded as one piece from a fiber reinforced plastic or other material. The back wall 146 and the side walls 144, 148 are slightly inclined relative to the base 42 at an obtuse angle. The back and side walls 144, 146, 148 intersect the base 42 at a radiused surface 152 (FIG. 5) to minimize local stress at the intersection which could lead to cracking and leaks.

The front wall 150 (FIGS. 3 and 5) includes the removable gate 22 which permits the appliance M to be slid on or off the base 42 without being lifted over the front wall. The removable gate 22 is formed from a modified aluminum extrusion or molded from a fiber reinforced plastic or other material. The removable gate 22 extends between the end portions 162, 164 of the front wall 150. The end portions 162, 164 and base 42 cooperate to define a frame 166 (FIGS. 5 and 6) for receiving and retaining the removable gate 22.

A continuous groove 182 (FIGS. 3, 5 and 6) is formed in the entire periphery of the frame 166. A continuous projection 184 (FIGS. 5 and 6) extends from the periphery of the removable gate 22 that engages the frame 166. An elastomeric seal 186 is located between the projection 184 and the groove 182. The groove 182, projection 184 and seal 186 cooperate to form a watertight seal at the interface of the frame 166 and the removable gate 22 when the removable gate is received in the frame.

The end portions 162, 164 reinforce and strengthen the side walls 144, 148 at a location near the front wall 150 and prevent movement between the side walls relative to one another and relative to the base 42. Such relative movement may occur during sliding the appliance M onto the overflow tray 20 or during operation of the appliance M in an unbalanced load condition, either of which may cause the appliance M to contact a side wall 144, 148. Therefore, damage to the side walls 144, 148 is minimized during movement of the appliance M relative to the base 42.

The front wall 150 also has retention structure to retain the removable gate 22 in a desired watertight relationship within the frame 166. Specifically, the removable gate 22 has an opening 202 (FIG. 6) at each axial end to receive a fastener 206 which connects the removable gate to a respective end portion 162, 164. A threaded opening 204 in each end portion 162, 164 receives the fastener 206 in threaded engagement. This prevents the removable gate 22 from being accidentally or unintentionally moved relative to the frame 166 which could disturb the sealing action of the projection 184 and groove 182. The threaded opening 204 could include a threaded metal insert molded into the overflow tray 20. The retention structure also reinforces and strengthens the side walls 144, 148 and prevents movement of the side walls relative to each other that could occur due to engagement with the appliance M. This reinforcement occurs because any attempted displacement of one side wall 144, 148 while the removable gate 22 is in place and fastened will be transmitted to the other side wall through the removable gate.

Each end portion 162, 164 has an inclined surface 222 (FIG. 6) which partially defines the frame 166. A bottom part 242 of the end portion 162, 164 located near the base 42 has a greater length L2 than the length L1 at an upper part 244 of the end portion which is spaced upwardly from the base, as viewed in FIG. 6. The removable gate 22 has a length L3 (FIG. 5) at its bottom which is greater than the distance to the outside of a pair of front or rear legs of the appliance M. Thus, the appliance M can be slid into the overflow tray 20 without engaging the end wall portions 162, 164 or side walls 144, 148.

From the above description of a preferred embodiment of the invention, those skilled in the art will perceive improvements, changes and modifications. Such improvements, changes and modifications within the skill of the art are intended to be covered by the appended claims.

Having described at least one preferred embodiment of the invention, what is claimed is:

1. An overflow tray for a water-containing appliance comprising:

a) a base for supporting the appliance, the base having an upper surface facing the appliance and including an opening for draining water from the tray, a portion of the upper surface sloping toward the opening;

b) a plurality of side walls extending upwardly from the base;

c) one side wall of the plurality of side walls including a pair of end portions cooperating with the base to define a frame for receiving a gate in watertight engagement, the end portions connected to ends of respective side walls adjacent the end portions, each end portion being tapered along a direction corresponding to a length of the one side wall such that the portion increases in dimension from an upper surface of the end portion to a lower region of the end portion adjacent the base to strengthen the end portions connected side wall; and d) the gate being removable from the frame to permit the appliance to be slid onto and off the base, the gate including side portions which are tapered to matingly engage portions of the frame defined by the tapered end portions, said gate side portions including extending means for removably securing said gate to said end portions.

2. The overflow tray in claim 1 further including a groove in one of said removable gate and said frame, a projection on the other of said removable gate and said frame, said projection being sized to fit in the groove to form a watertight seal between said removable gate and said frame.

3. The overflow tray in claim 2 wherein said groove is located in said frame and extends substantially for the entire periphery of said frame and said projection is located on said removable gate.

4. The overflow tray in claim 2 further including an elastomeric seal located between said projection and groove.

5. The overflow tray in claim 1 wherein said opening is located substantially at a center of said base.

6. The overflow tray in claim 1 further including at least one additional opening in said base for receiving a fastener in a watertight relationship to secure said overflow tray to a support surface.

7. The overflow tray in claim 1 further including a pair of fasteners, each fastener extending between a respective end of said removable gate and a corresponding one of the end portions for retaining said removable gate in engagement with said frame and for inhibiting said adjacent side walls connected to the end portions from moving relative to one another and relative to said base.

8. The overflow tray in claim 1 further including at least one substantially planar portion of said appliance facing surface of said base for directly supporting the appliance.

9. The overflow tray in claim 1 further includes a radiused surface extending between said base and each of said connected side walls.

10. The overflow tray as set forth in claim 1 wherein for each of the end portions, the dimension of the end portion in the direction corresponding to the length of one side wall is greater than a width of its connected side wall, and the gate extension means includes flanged portions extending along the upper surface of the gate which overlie the upper surfaces of respective end portions when the gate is inserted in the frame.

* * * * *

UNITED STATES PATENT AND TRADEMARK OFFICE

CERTIFICATE OF CORRECTION

PATENT NO. : 5,452,739 
DATED : September 26, 1995
INVENTOR(S) : Robert J. Mustee and William E. Trsek It is certified that error appears in the above-identified patent and that said Letters Patent is hereby corrected as shown below:

Title page,
Illustrated figure 1 should be deleted.

Drawings,
Sheet 3 of 3, delete Figure 1 and insert Figures 5, 6, 7 and 8 as shown below.

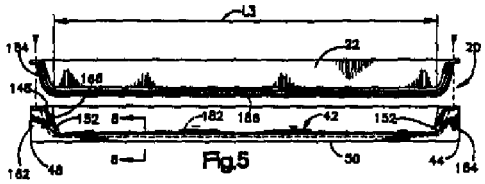

Fig.5

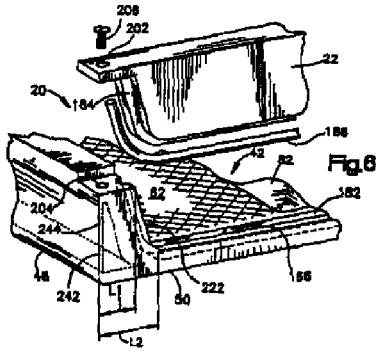

Fig.6

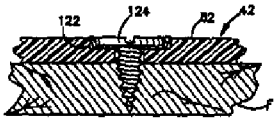

Fig.7

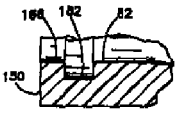

Fig.8

Signed and Sealed this

Twenty-second Day of March, 2005

JON W. DUDAS
*Director of the United States Patent and Trademark Office*